US006394374B1

(12) United States Patent
Hamada et al.

(10) Patent No.: US 6,394,374 B1
(45) Date of Patent: May 28, 2002

(54) DISINTEGRATING AND GRAIN-REGULATING DEVICE FOR GRANULES

(75) Inventors: Kenji Hamada; Takashi Tashiro; Fumiaki Tanabe, all of Tokyo (JP)

(73) Assignee: Nara Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/581,573

(22) PCT Filed: Oct. 13, 1999

(86) PCT No.: PCT/JP99/05630

§ 371 (c)(1),
(2), (4) Date: Jul. 11, 2000

(87) PCT Pub. No.: WO00/21674

PCT Pub. Date: Apr. 20, 2000

(30) Foreign Application Priority Data

Oct. 15, 1998 (JP) ..... 10-293813

(51) Int. Cl.[7] ..... B02C 13/282

(52) U.S. Cl. ..... 241/188.2; 241/259; 241/259.1; 241/261.1

(58) Field of Search ..... 241/188.2, 188.1, 241/259, 257.1, 259.1, 261.1

(56) References Cited

FOREIGN PATENT DOCUMENTS

| | | |
|---|---|---|
| JP | B-46-40981 | 12/1971 |
| JP | U-52-81667 | 12/1975 |
| JP | A-53-67161 | 6/1978 |
| JP | U-61-91337 | 6/1986 |
| JP | A-5-68902 | 3/1993 |
| JP | A-8-47650 | 2/1996 |

*Primary Examiner*—Mark Rosenbaum
(74) *Attorney, Agent, or Firm*—Oliff & Berridge PLC

(57) ABSTRACT

A crushing and particle sizing apparatus for granular material in which the particle size can be controlled without the use of a screen or similar apparatus. A gap region is formed as a particle size adjusting region which allows particles suited to the gap setting to pass. Particles not suited to the gap setting are brought into rotational contact with a rotating body and crushed to the suited gap setting.

16 Claims, 7 Drawing Sheets

DISINTEGRATING AND GRAIN-REGULATING DEVICE FOR GRANULES

TECHNICAL FIELD

The present invention relates to a crushing and particle sizing apparatus for granular material for sizing, into a predetermined particle size, various wet or dry materials such as drugs, foods, fodder, chemicals, fertilizers, fine coals and limestone which were granulated or formed by various apparatuses. More particularly, the present invention relates to a crushing and particle sizing apparatus for granular material for crushing wet aggregates or dry blocks, i.e., granulated materials (lump) granulated or formed by various apparatuses and having particle size equal to or greater than a target value, and for sizing the crushed materials into a constant particle size range.

BACKGROUND ART

At present, mixing, granulating and sizing operations are carried out in various fields including pharmaceutical and food fields. A particle size adjusting operation in a produce manufacturing process is an important unit operation for enhancing the handling such as the quality of particles and fluidization the time of fluidizing and drying operation. However, the conventional crushing and particle sizing apparatus for granular material is designed such that the particle size is controlled by screen.

That is, as shown in FIG. 7, in the conventional crushing and particle sizing apparatus for granular material, a cylindrical screen (classifier mechanism) c is mounted to an upper casing b provided with a material input port a. A rotation shaft d associatively connected to a driving mechanism is vertically fitted in a center of the screen c. By horizontally a plurality of rotating granulating blades e formed on the rotation shaft d at predetermined distanced from one another, wet aggregates or dry blocks are crushed, and particle which is sized into a predetermined particle size is discharged from a sized particle hole c1 of the cylindrical screen c.

However, if such a screen c is used, it is necessary to prepare various cylindrical screens c having different sizing holes depending upon desired particle sizes in order to sizing particles into the predetermined particle size. After the screen c was used, it must be cleaned. Further, if the screen is continuously used, the screen itself is worn and damaged, and friction particle or broken piece of the screen may adversely mixed into the product particles. Therefore, it is necessary to frequently check the screen, and there is a drawback that strict quality control must be carried out.

Further, in the case of the wet material, the screen is prone to be clogged depending upon physical characteristics of a material to be processed, and there is a problem that the material to be processed is adversely kneaded inside the screen c. In the case of any of the wet material and dry material, particle having appropriate particle size is also crushed by impact force of the granulating blade e, and there is a problem that fine particle is generated by the gross, and yield is inferior.

The present invention has been accomplished to solve the above-mentioned problems, and it is an object of the invention to provide a crushing and particle sizing apparatus for granular material in which the particle size can be controlled without using a screen at all, it is possible to eliminate the need of cleaning operation after the apparatus is used, a strict quality control to prevent the friction particle or the broken piece of the screen from being mixed into a product, and an inconvenience caused by using the screen such as clogging of the screen, and it is possible to eliminate an inconvenience that a material to be processed is kneaded when a wet material is used, or that particle having appropriate particle size is also crushed to generate fine particles by the gross to deteriorate the yield when the wet material or dry material is used, and it is possible to size particles within an appropriate particle size range.

DISCLOSURE OF THE INVENTION

To achieve the above object, according to technical means employed in the present invention, there is provided a crushing and particle sizing apparatus for granular material for sizing, through a predetermined reserving region, wet or dry material granulated or formed by various devices and supplied from a material input port, the apparatus comprising casing, a rotation body, an opposed face portion opposed to the rotation body at a predetermined distance, and a gap region defined by the rotation body and the opposed face portion which are provided within the casing, the gap region comprising a particle size adjusting region which allows particles suited to the gap setting to pass but does not allow particles not suited to the gap setting to pas, wherein the particles not allowed to pass through the gap region are brought into contact with the opposed face portion in association with rotation of the rotation body at an inlet or face sections of the gap region and are crushed to such an extent that the particles can pass through the gap region and discharged from a discharge port.

BEST MODE FOR CARRYING OUT THE INVENTION

Figure 1:
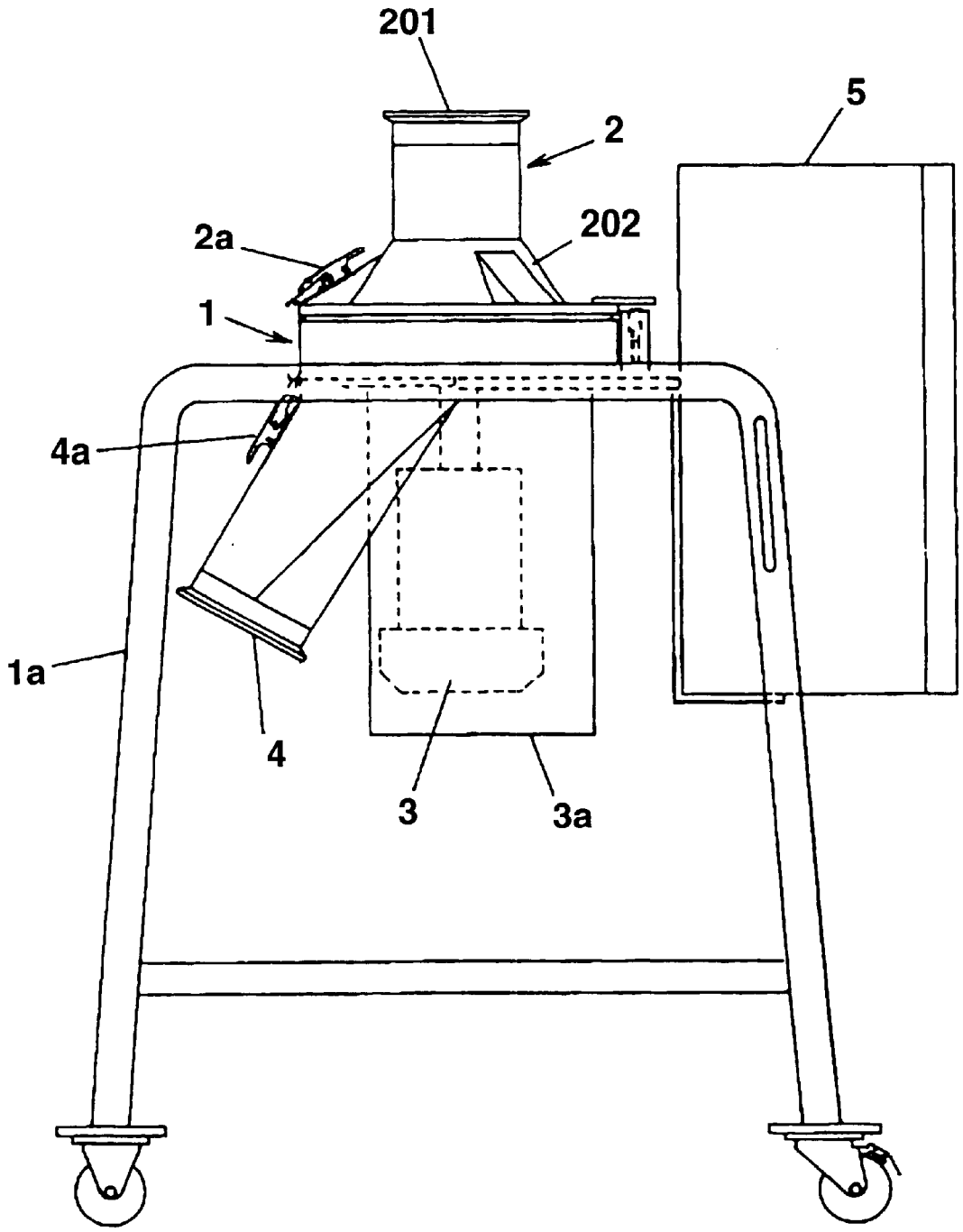
FIG. 1 is a general side view of a crushing and particle sizing apparatus for granular material.

A crushing and particle sizing apparatus for granular material which is shown as a preferred embodiment of the present invention will be explained in detail.

In FIGS. 1 to 5, FIG. 1 is a general side view of a crushing and particle sizing apparatus for granular material. A reference number 1 represents a base casing whose interior mounted to a pipe stand 1*a* is formed into a circular groove shape. An upper casing 2 is detachably mounted to an upper portion of the base casing 1 by three adjust fasteners 2*a*. The upper casing 2 is integrally formed of a substantially hollow conical member constituting a particle retention region 202 between a cylindrical material input port 201 and a conical rotation body which will be described later. A driving apparatus 3, its case cover 3*a*, and a discharge port 4 are mounted to a lower portion of the base casing 1. Like the upper casing 2, the discharge port 4 is also detachable with by means of adjust fasteners 4*a*. A reference number 5 represents a control panel mounted to the pipe stand 1*a*.

Figure 2:
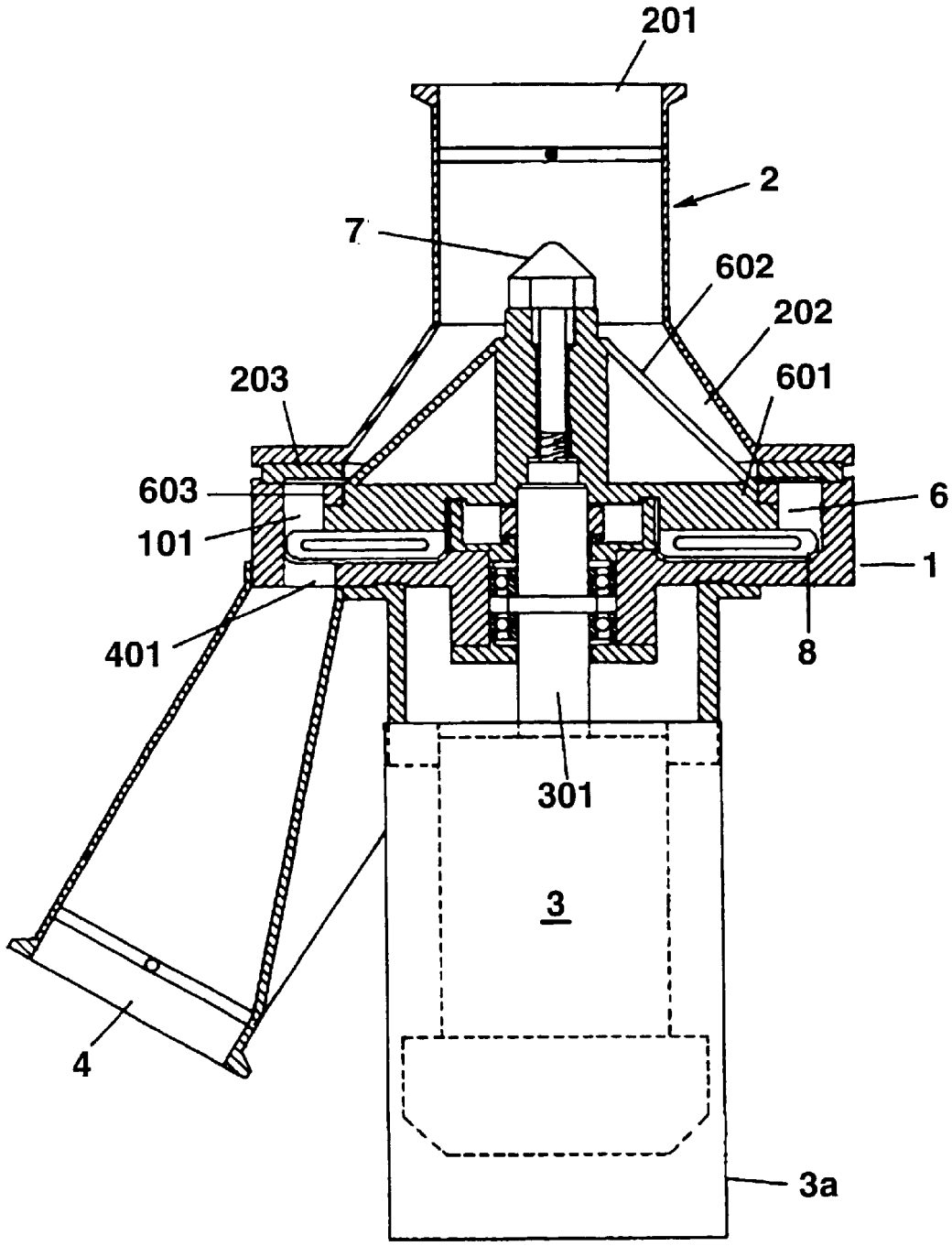
FIG. 2 is a sectional side view of the crushing and particle sizing apparatus for granular material.

FIG. 2 is a side sectional view of FIG. 1. A reference number 6 represents a rotation body provided in the base casing 1. The rotation body 6 is integrally formed of a disc-like rotation body 601 whose center portion is detachably mounted to a rotation shaft 301 associatively connected to the driving apparatus 3, and a conical rotation body 602 provided on the disc-like rotation body 601. The rotation body 6 is connected to the rotation shaft 301 by threadedly inserting a bolt 7 from a top of the conical rotation body 602.

The particle retention region 202 formed between the conical rotation body 602 and the substantially conical member of the upper casing 2 is designed such that its width is narrowed toward the disc-like rotation body 601 in a state where inclining angles of both of them are set different.

The disc-like rotation body 601 is disposed at a predetermined space from a lower portion and a side portion of an inner wall of a groove of the base casing 1 such as to form a particle discharging region 101. An outer diameter of a bottom face (connecting face) of the conical rotation body 602 is set smaller than that of the disc-like rotation body 601.

The disc-like rotation body 601 is provided with four rotor pieces 8 separated through 90° from one another for smoothly discharging the particles. The rotor pieces 8 are operated associatively with the turning motion of the driving apparatus 3 by a driving operation of the control panel 5 so that the rotor pieces 8 are turned in unison with the rotation body 6. The sized particles are discharged from a discharge hole 401 formed in a portion of an outer periphery of an inner wall bottom of the base casing 1. It is preferable that each of the rotor pieces 8 is not of a merely flat plate shape. Rather, the central portions of the rotor pieces 8, with the exception of the outer peripheral portion, are notched. By forming the rotor pieces 8 into such a shape, airflow caused by the turning motion of the rotor pieces 8 is suppressed to prevent the discharged particle from being aggregated again. When wet material is used, it is prevented from being pushed against the inner wall of the base casing 1, and kneaded between the rotor pieces 8 and the inner wall of the base casing 1.

The disc-like rotation body 601 is provided at its circumferential end edge with a ring member 603. The upper casing 2 is provided with a ring member 203 constituting opposed face portion which is opposed to the ring member 603 at a predetermined distance. A gap region 9 is formed around the entire circumference by the ring member 203 and the rotation body 6 including the ring member 603 and the skirt end edge of the conical rotation body 602.

Figure 3:
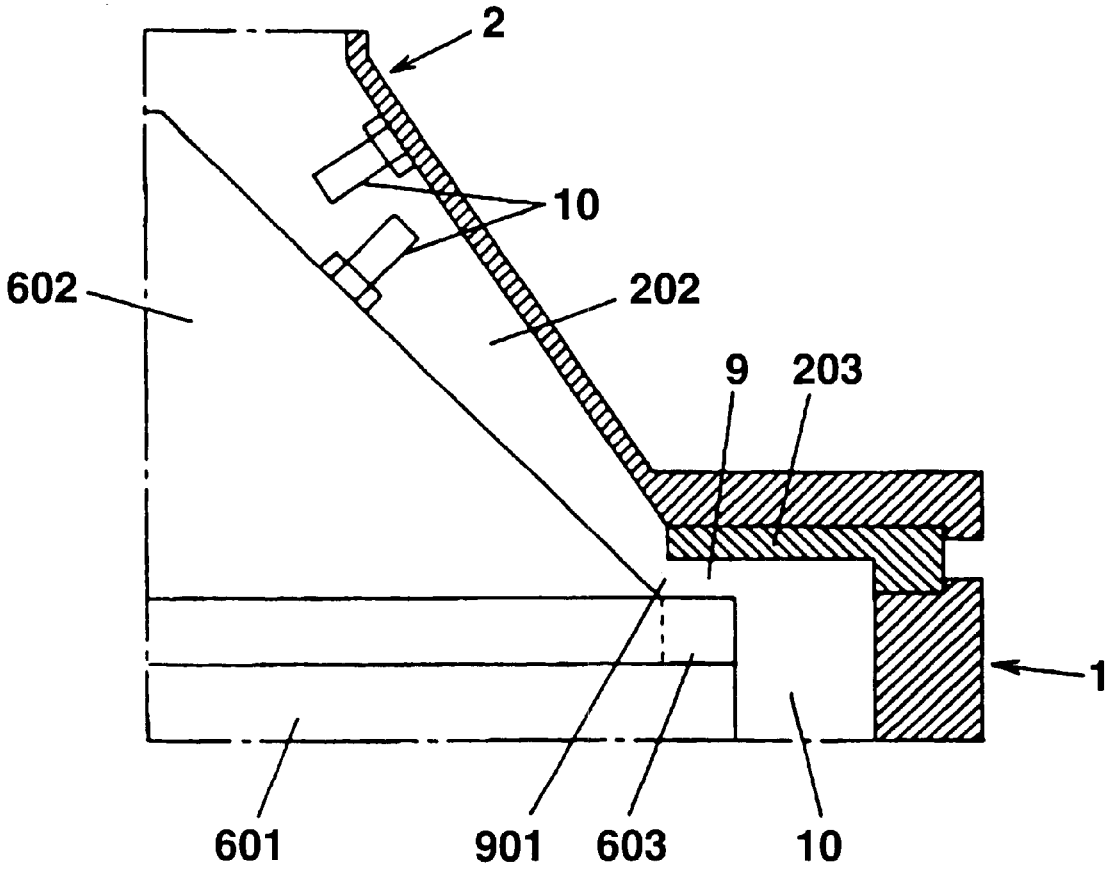
FIG. 3 is an explanatory view of an essential portion of a gap region.

FIG. 3 is an explanatory view of an essential portion of the gap region. The gap region 9 is formed as a particle size adjusting region which allows particle which is suited with a predetermined gap setting to pass through the gap region 9 but does not allow coarse particle to pass therethrough. That is, in the gap region 9 formed by the ring member 203 constituting the opposed face portion, the ring member 603 constituting the rotation body 6 and the skirt end edge of the conical rotation body 602, the rotation body 6 is constituted by a horizontal face and an inclined face. The shortest gap of the inclined face formed by a corner of the ring member 203 and the skirt end edge of the conical rotation body 602 and a gap between the opposed ring members 203 and 603 are set substantially equal each other, or the former gap is set slightly S narrow. In the present embodiment, a narrowest gap 901 having narrowest gap is formed. With this design, the gap region 9 comprises face sections at which both the ring members 203 and 603 are opposed and line sections of the narrowest gap 901. The ring member 203 may be integrally formed with the upper casing 2 as an opposed face portion, the rotation body 6 may not have the conical rotation body 602, the position of the narrowest gap 901 is not limited to the above-described position and may arbitrary set the position by changing the shapes of the ring members 203 and 603, and the gap region 9 may not be provided with the narrowest gap 901. Although the gap region 9 is formed around the entire circumference region in the present embodiment, the gap region 9 may be formed halfway around the circumference region, or may be divided into a plurality of pieces, or a plurality of gap regions may be formed into a multi-stage or multi-layer structure, for example, the conical rotation body 602 may be provided at its medium portion with the ring member 603 whose diameter is changed and in short, any gap region may be used only if appropriate sizing operation can be carried out in accordance with a processing amount, processing time, the physical characteristics of material to be processed and the like.

A gap of the gap region 9 may be arbitrary set in accordance with a target maximum particle diameter of a particle to be processed. In the present embodiment, the gap can be changed into a set value within a range of 0.5 mm to 4 mm, and this value is set to two to three times of the target maximum particle diameter. The set value may be changed by preparing some kinds of ring members 203 having different thickness, removing the upper casing 2 and mounting appropriately selected ring member 203, or by vertically moving the ring member 203 itself, or by vertically moving the rotation body 6. Any method may be selected. In the present embodiment, some kinds of ring members 203 having different thickness are prepared to adjust the particle size.

A reference number 10 represents crush pins 10. When a supplied material is dry for example, the crush pins 10 roughly crush the supplied material. The crush pins 10 are mounted on an inner wall of the upper casing 2 located on the side of the material input port 201 of the particle retention region 202 and on the conical rotation body 602 at a predetermined distance from each other. If these two crush pins 10 are defined as a pair of crush pins 10, six pairs of crush pins 10 are detachably mounted at equal distances from one another. When the supplied material is dry and coarse, and the material is caught in the particle retention region 202 and can not move into the gap region 9 below the particle retention region 202, the crush pins 10 are used to roughly crush the supplied material to assist the crushing and sizing operation in the gap region 9. When it is unnecessary to roughly crush the material, the crush pins 10 are removed.

Figure 4A:
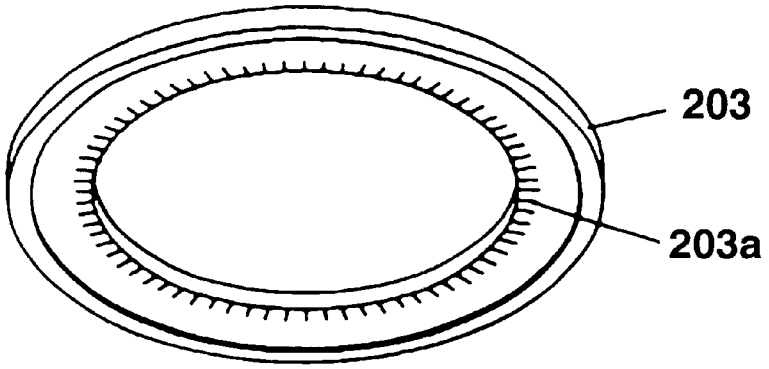
FIG. 4 is a diagram of an outer appearance showing an embodiment of a ring member.
Figure 4B:
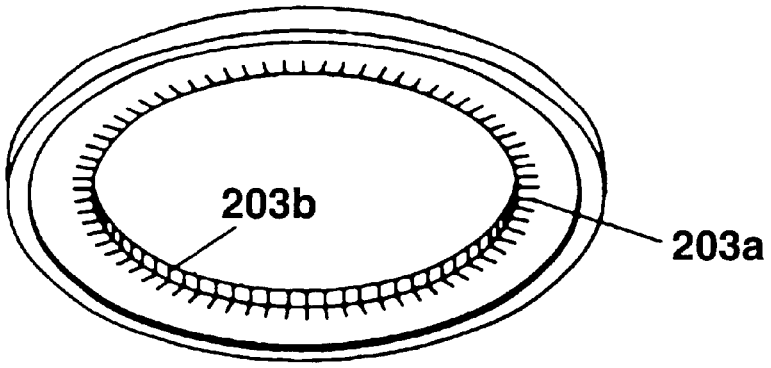
Figure 4C:
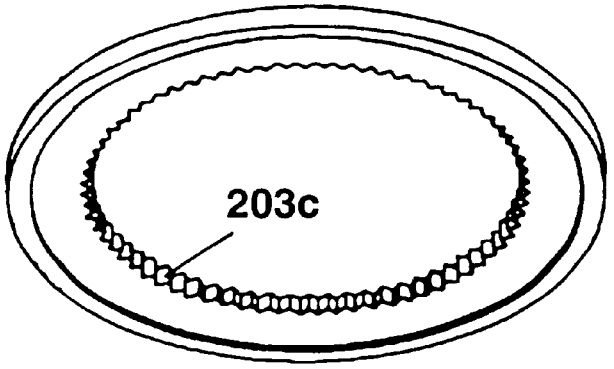
Figure 5A:
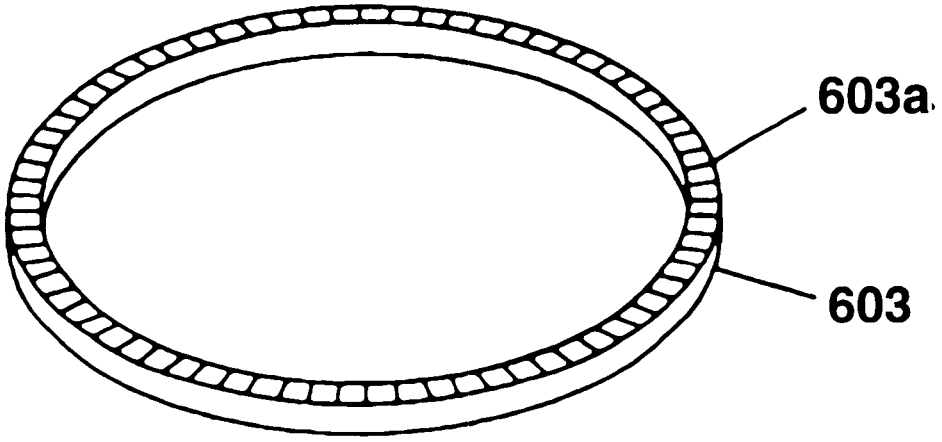
FIG. 5 is a diagram of the outer appearance showing the embodiment of the ring member.
Figure 5B:
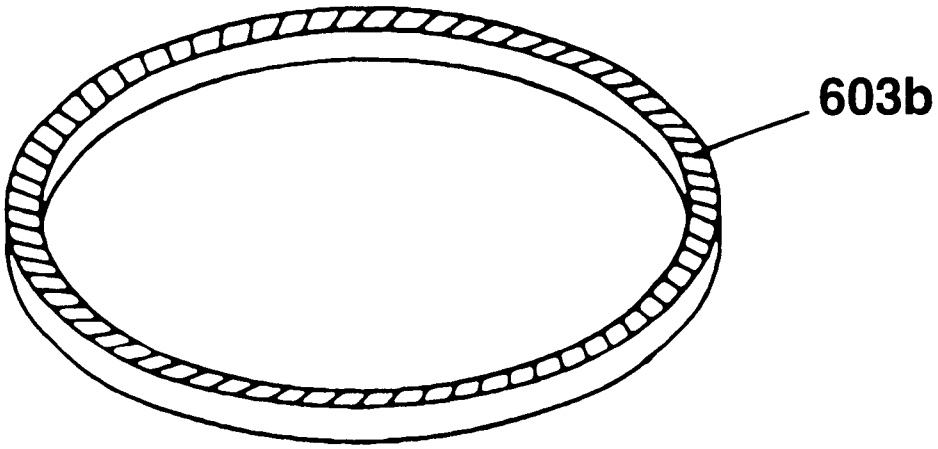

Usually, particle-contact portions of the ring members 203 and 603 are flat and smooth, but FIGS. 4 and 5 show outer appearance of embodiments in which the ring members 203 and 603 are formed with projections and recesses. First, FIG. 4(*a*) shows a structure in which a lower face inner peripheral end edge of the ring member 203 that is opposed to the ring member 603 is radially provided with V-like linear grooves 203*a* through equal angles from one another, and the lower face inner peripheral end edge of the ring member 203 is provided with projections and recesses. FIG. 4(*b*) shows a structure in which an inner peripheral side face of the ring member 203 is also provided with V-like linear grooves 203*b* at equal distances from each other in addition to the lower face peripheral end edge of the ring member

203. FIG. 4(*c*) shows a structure in which a degree of the projections and recesses shown in FIG. 4(*b*) are further increased.

Next, FIG. 5(*a*) shows a structure in which an upper face of the ring member 603 is radially provided with grooves 603*a* at through equal angles from one another in the same manner as above to form projections and recesses on the upper face of the ring member 603. FIG. 5(*b*) shows a structure in which V-like linear grooves 603*b* which are inclined through a constant angle with respect to a straight line passing through the center of the ring member 603, and the V-like linear grooves 603*b* are formed at equal distances on the upper face of the ring member 603 to form projections and recesses on the upper face. The grooves 603*b* may not be straight and may be curved.

The grooves 203*a*, 603*a* and 603*b* formed on opposed faces of the ring members 203 and 603 of course have sizing function, and also have functions to smoothly push the particles toward a discharge region 101 or allow the particles to stay in the gap region 9 on the contrary. The grooves 203*b* and 203*c* have function to make it easier to crush and size the particles. In stead of grooves 203*a*, 203*b*, 603*a* and 603*b*, inverted V-shape projections may be provided, the ring members 203 and 603 themselves may be changed in shape such as trapezoidal cross sections.

Figure 6:
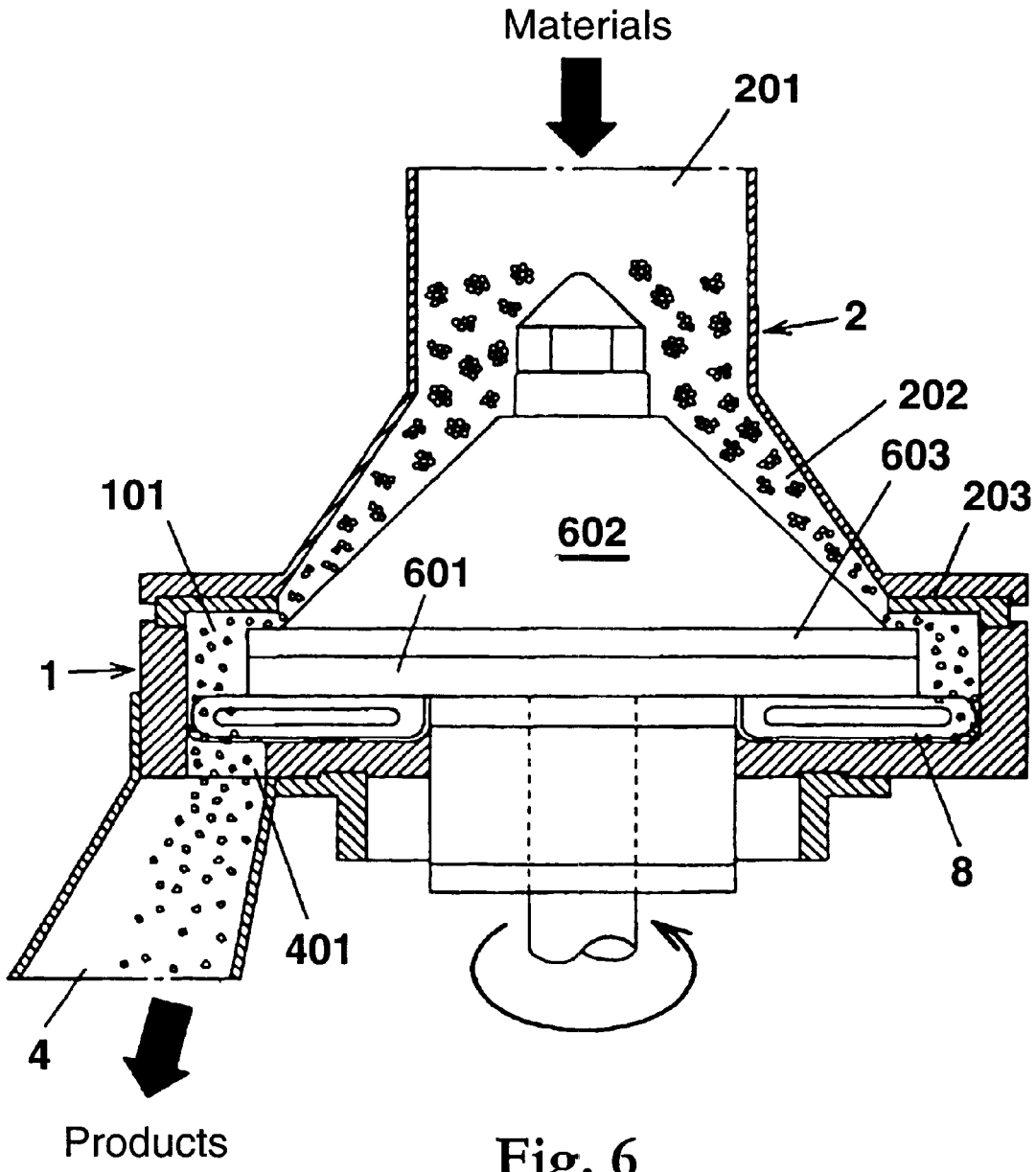
FIG. 6 is an explanatory view of the operation of the crushing and particle sizing apparatus for granular material.
Figure 7:
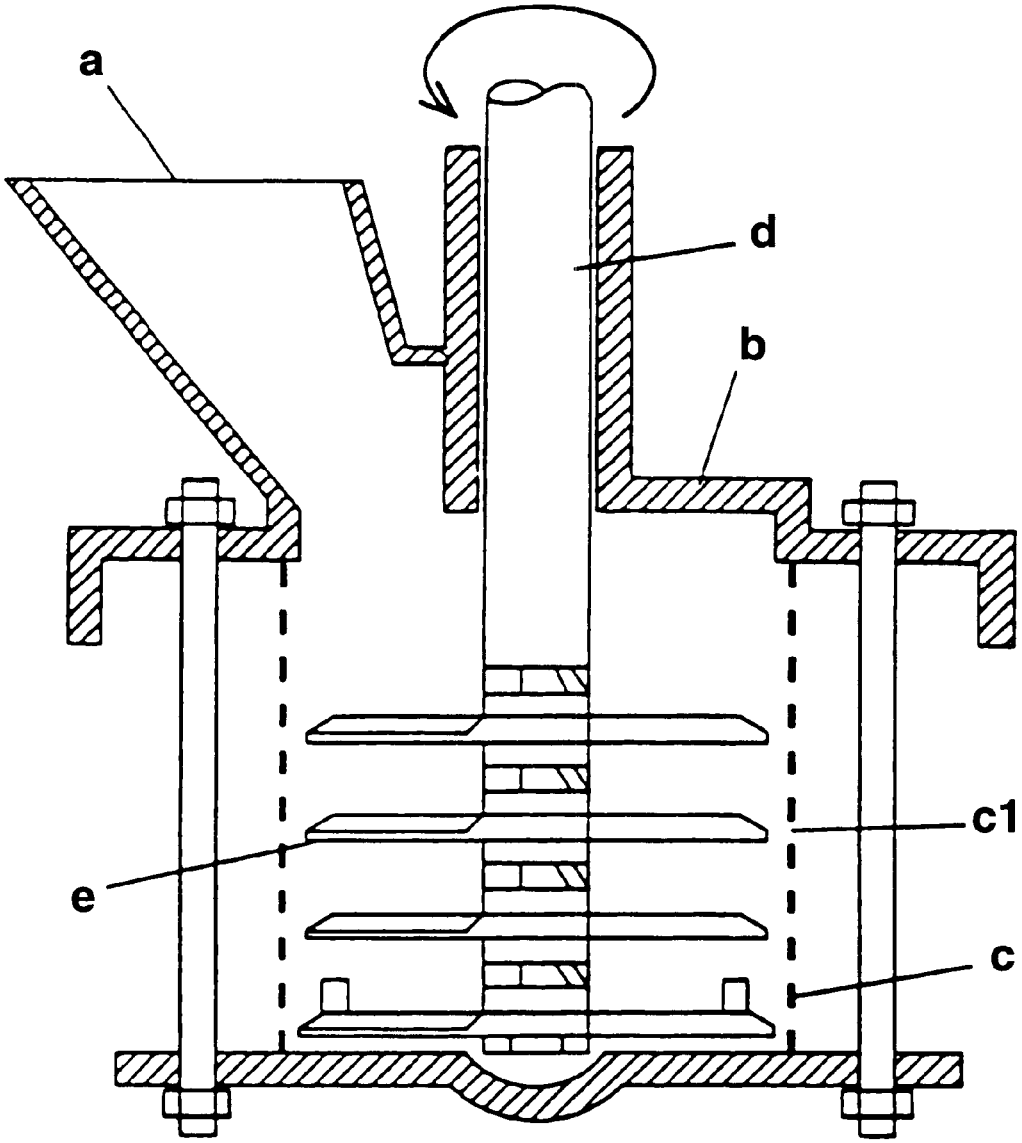
Fig. 7 PRIOR ART
FIG. 7 is a schematic sectional view showing a conventional crushing and particle sizing apparatus for granular material.

In the embodiment of the present invention having the above-described structure, if materials such as wet aggregates or dry blocks which are raw materials are supplied from the material input port 201 in a state where the rotation body 6 is turned as shown in FIG. 6, the supplied material remains in the particle retention region 202. The particle retention region 202 is designed such that its width is narrowed toward the gap region 9, and the material input port 201 is provided at the central portion. Therefore, the supplied material is uniformly collected toward the gap region 9 by the action of the gravity of the supplied material and the centrifugal force by the turning motion of the conical rotation body 602. Particles suited to the gap setting can pass through the gap region 9, but particles not suited to the gap setting can not pass therethrough.

However, in the crush sizing apparatus for particles, since the gap region 9 is formed as the particle size adjusting region, coarse particles which are refused to pass come into contact with the opposed faces which contribute to the crushing operation including the comer of the ring member 203 in association with the turning motion of the conical rotation body 602 at the inlet of the narrowest gap 901 or in the vicinity of face sections thereof, and the particles are crushed to such a degree that they can pass through the gap region 9. The particles which have passed through the narrowest gap 901 are further crushed and sized also in the opposed face region between the rear ring members 203 and 603 and then, are discharged into the discharge region 101.

Therefore, although this is the crushing and particle sizing apparatus for granular material, this apparatus can control the particle size without using a screen at all unlike the conventional apparatus, it is possible to eliminate the need of cleaning operation after the apparatus is used, a strict quality control to prevent the friction particle or the broken piece of the screen from being mixed into a product, and an inconvenience caused by using the screen such as clogging of the screen, and the upper casing 2, the discharge port 4 and the rotation body 6 can easily be detached and attached, the apparatus itself can be cleaned with excellent operability.

Further, it is possible to eliminate an inconvenience that a material to be processed is kneaded when a wet material is used, or that particle having appropriate particle size is also crushed to generate fine particles by the gross to deteriorate the yield when the wet material or dry material is used, and it is possible to size particles within an appropriate particle size range.

That is, when the particles are crushed, the fact that fine particles are not generated is confirmed by the following effects: for example, lactose and cornstarch are mixed in proportions of 7 to 3 and then, 1% of aqueous solution of HPC-L (hydroxypropylcellulose) is added in an amount corresponding to 21% of the mixture particle weight, and the resultant is granulated to form wet granulated material. When the latter is sized into a particle diameter in a range of 0.1 to 1 mm using the wet granulated material, in a sizing processing test in which a gap of the gap region 9 is set to 3 mm (narrowest gap is 2 mm), the rate of 1 mm or greater in the raw material is about 20%, whereas the rate of the product after the processing is about 1 mm or less about 100%, and the rate less than 0.1 mm or less is not increased almost at all.

It can be conceived that this is because that the particles suited to the gap setting were swiftly allowed to pass, and only the coarse particles, which were refused to pass, are selectively crushed and sized and thus, the fine particles are suppressed to be generated.

It has been confirmed that the particle size of the produce can be controlled also by adjusting the width of the gap region 9 and the rotating speed of the rotation body 6.

Further, by using the ring member 203 constituting the opposed face portion on which the grooves 203*b* and 203*c* are formed and the projections and recesses are formed, the rotating speed of the rotation body 6 is adjusted and the contact degree of the particles with respect to the opposed face portion can be adjusted, and the crushing and sizing operation suitable for the characteristics of the processing material which is raw material can be carried out. In the crushing operation, the corner of the ring member 203 forming the narrowest gap 901 is square, but the corner may be formed into a blade-shape or chamfered shape.

It is also possible to uniform the particles into predetermined sized shape to suppress the variation in product shape by combining the grooves 203*a* and 603*a* or 603*b* in the opposed face region between the ring members 203 and 603. In addition, it is possible to smoothly discharge the particles toward the discharge region 101 or to remain the particles in the gap region 9 on the contrary.

The sized particles are discharged to the discharge region 101 in this manner. The discharge region 101 is provided with the rotor pieces 8 on the lower face of the disc-like rotation body 601, the particles can efficiently be sent out toward the discharge hole 401 by turning the rotor pieces 8, and sized product can be taken out from the discharge port 4.

INDUSTRIAL APPLICABILITY

According to the present invention, there is provided a crushing and particle sizing apparatus for granular material for sizing, through a predetermined reserving region (101), wet or dry material granulated or formed by various devices and supplied from a material input port (201), the apparatus comprising casing (1, 2), a rotation body (6), an opposed face portion opposed to the rotation body (6) at a predetermined distance, and a gap region (9) defined by said rotation body (6) and the opposed face portion which are provided within the casing (1, 2), the gap region (9) comprising a particle size adjusting region which allows particles suited to the gap setting to pass but does not allow particles not suited to the gap setting to pass, wherein the particles not allowed to pass through said gap region (9) are brought into contact with the opposed portion in association with rotation of the rotation body (9) at an inlet or face sections of said gap region (9) and are crushed to such an extent that the particles can pass through the gap region (9) and discharged from a discharge port (4). Therefore, although this is the crushing and particle sizing apparatus for granular material, the particle size can be controlled without using a screen at all, it is possible to eliminate the need of cleaning operation after the apparatus is used, a strict quality control to prevent the friction particle or the broken piece of the screen from being mixed into a product, and an inconvenience caused by using the screen such as clogging of the screen, and it is possible to eliminate an inconvenience that a material to be processed is kneaded when a wet material is used, or that particle having appropriate particle size is also crushed to generate fine particles by the gross to deteriorate the yield when the wet material or dry material is used, and it is possible to size particles within an appropriate particle size range.

What is claimed is:

1. A crushing and particle sizing apparatus for granular material that sizes particles of wet or dry material, said apparatus comprising:

a casing including a substantially hollow conical member, a material inlet port and a discharge port;

a conical rotation body and a disc-like rotation body provided within said casing, a gap between the conical rotation body and the substantially hollow conical member defining a particle retention region that narrows in the direction of the disc-like rotation body; and an opposing face portion providing within said casing, opposed to the rotation bodies and spaced from the rotation bodies, a gap region being defined between said disc-like rotation body and said opposing face portion, the gap region including a face section and a line section;

wherein particles too large to pass through said gap region are brought into contact with said opposing face portion at the face section and line section in association with rotation of said rotation bodies and are crushed between said rotation bodies and said opposing face portion to such an extent that the particles can pass through said gap region and be discharged from the discharge port.

2. The crushing and particle sizing apparatus for granular material according to claim 1, wherein the gap region includes a narrowest gap portion formed at an upstream side of the gap region, and the particles are crushed in said narrowest gap portion or vicinity thereof.

3. The crushing and particle sizing apparatus for granular material according to claim 2, wherein an inner surface of the casing and said conical rotation body are provided with a plurality of crushing pins that roughly crush material supplied through the material inlet port.

4. The crushing and particle sizing apparatus for granular material according to claim 1, wherein said gap region is provided around an entire circumference of the disc-like rotation body.

5. The crushing and particle sizing apparatus for granular material according to claim 1, wherein said disc-like rotation body comprises a horizontal face portion and the conical rotation body comprises an inclined face portion.

6. The crushing and particle sizing apparatus for granular material according to claim 1, wherein said opposing face portion comprises a ring-shaped member.

7. The crushing and particle sizing apparatus for granular material according to claim 1, wherein at least a portion of a surface of said disc-like rotation body is an uneven surface.

8. The crushing and particle sizing apparatus for granular material according to claim 1, wherein at least a portion of a surface of said opposing face portion is an uneven surface.

9. The crushing and particle sizing apparatus for granular material according to claim 1, wherein said material inlet port is provided in a central portion of said casing.

10. The crushing and particle sizing apparatus for granular material according to claim 1, further comprising a discharge device that assists in discharging material from the discharge port, the discharge device including at least one rotor piece that moves particles, which have passed said gap region, toward the discharge port.

11. The crushing and particle sizing apparatus for granular material according to claim 10, wherein a central portion of said at least one rotor piece is removed.

12. The crushing and particle sizing apparatus for granular material according to claim 10, wherein said at least one rotor piece rotates in unison with said rotation body.

13. The crushing and particle sizing apparatus for granular material according to claim 1, wherein said material inlet port is substantially coaxial with an axis of rotation of said rotation bodies.

14. The crushing and particle sizing apparatus for granular material according to claim 1, wherein a size of said gap region is adjustable by adjusting a distance between disc-like rotation body and said opposing face portion.

15. The crushing and particle sizing apparatus for granular material according to claim 1, wherein the disc-like rotation body includes a ring-shaped member mounted opposing said opposing face portion.

16. The crushing and particle sizing apparatus for granular material according to claim 1, wherein the material is crushed into particles with a diameter size of about 0.1 to about 1 mm.

* * * * *